United States Patent [19]

Pommat et al.

[11] 4,252,172

[45] Feb. 24, 1981

[54] TENSIONING DEVICE FOR A ROLLING SCREEN ARRANGEMENT

[75] Inventors: Alain Pommat; Andre Buffet, both of Cluses, France

[73] Assignee: Etablissements Carpano & Pons, Cluses, France

[21] Appl. No.: 736,099

[22] Filed: Oct. 27, 1976

[30] Foreign Application Priority Data

Oct. 28, 1975 [FR] France ..... 75 33488

[51] Int. Cl.[3] ..... A47G 5/02

[52] U.S. Cl. ..... 160/322

[58] Field of Search ..... 160/23 R, 265, 274, 160/275, 276, 277, 278, 309, 310, 319, 320, 321, 322, 133, 202

[56] References Cited

U.S. PATENT DOCUMENTS

| | | | |
|---|---|---|---|
| 262,398 | 8/1882 | Gerard | 160/265 |
| 582,243 | 5/1897 | Trumble | 160/322 |
| 673,779 | 5/1901 | Morgan | 160/322 |
| 1,134,326 | 4/1915 | Gambon | 160/322 |
| 2,057,850 | 10/1936 | Sims | 160/202 |
| 3,074,474 | 1/1963 | Dunn | 160/23 R |

*Primary Examiner*—Peter M. Caun

*Attorney, Agent, or Firm*—Robert E. Burns; Emmanuel J. Lobato; Bruce L. Adams

[57] ABSTRACT

A rolling screen arrangement such as a window blind, a rolling garage door or a projection screen comprises a tensioning device applying a progressively increasing tension on the flexible rolling element as it unwinds.

1 Claim, 8 Drawing Figures

TENSIONING DEVICE FOR A ROLLING SCREEN ARRANGEMENT

BACKGROUND OF THE INVENTION

The invention concerns rolling screen arrangements of the type comprising a flexible sheet-like element wound on a rod-like windings support which is rotatable for winding and unwinding of the flexible element onto and off of the support, and a tensioning device acting on a trailing end of the flexible element to hold the element under tension.

Such arrangements may be rolling window blinds or shades (which the flexible element is a fabric or a series of articulated laths), projection-screens, rolling garage doors and so forth.

In known tensioning devices for arrangements of this type, such as that described in W. German published Patent Application (DOS) No. 2341328, drums are provided solid for rotation with the winding support. A flexible cord is wound by one end on each drum with a direction of winding opposite to that of the flexible element on the winding support. The other end of each cord, which is held under tension by means of suspended weights and associated guide carriages, is connected to the trailing end of the flexible element so that the flexible element is permanently held at constant tension during winding and unwinding.

Likewise, U.S. Pat. No. 3,279,528 describes an arrangement of the same type in which the flexible element of "shade" is held at constant tension so that it can be stopped at any intermediate position without the need for additional catches or locks.

However, it has been observed that permanently holding the flexible element under tension, even when it is fully or almost fully wound, is unnecessary and disadvantageous in that the inflexible element, its winding support and winding mechanism are constantly subjected to stress.

SUMMARY OF THE INVENTION

The invention accordingly proposes, in an arrangement of the type set forth, an improved tensioning device acting on said trailing end of the flexible element to hold said element under tension, said device comprising mechanical means kinematically connected to the winding support for varying said tension whereby said tension increases as the flexible element unwinds from the support.

With a device according to the invention, it is thus possible to arrange for the tension on the flexible element to be zero or very slight when the flexible element is fully wound on the support, but to increase progressively, as the flexible element is unwound, up to a maximum value when the flexible element is fully unwound. Any flapping of the flexible element when it is fully or partially unwound is thus prevented, whereas when the flexible element is fully wound it exerts practically no mechanical stresses on the winding support and its winding mechanism.

In one embodiment, comprising at least one drum fixed for rotation with the winding support and a flexible cord or belt having a first end wound on each said drum with a direction of winding opposite to that of the flexible element on the support and a second end connected to the trailing end of the flexible support and in which the tensioning means is an elastic element acting to maintain the non-wound part of the cord under tension, said drums each have a cylindrical surface of greater diameter than the maximum diameter of the wound element on its support, said first end of the cord being wound on the cylindrical surface of the drum.

Alternatively, in a similar embodiment, each said cylindrical drum is replaced by a drum having a generally conical surface whose minimum diameter is at least equal to the maximum diameter of the wound element on the winding support. Said first end of the cord is connected to the conical surface adjacent a part of minimum diameter so that it progressively winds, in response to unwinding of the flexible element from the support, onto parts of said surface of greater diameter.

In another similar embodiment each drum has a cylindrical surface of diameter at least equal to the maximum diameter of the wound element on the support and a width approximately equal to that of the cord, which is advantageously a flat belt. Guide means are provided for spirally winding the cord on the drum in successive layers whereby the outer diameter of the wound cord on the drum increases in response to unwinding of the flexible element from the support.

In the above-mentioned embodiments, the tensioning means may be a suitably arranged traction, compression or spiral spring, possibly connected between the trailing end of the flexible element and the end of the cord(s).

Another embodiment comprises at least one drum fixed for rotation with the winding support, this drum having a cylindrical surface of greaters diameter than the maximum diameter of the wound element on its support. An endless belt passes about the cylindrical surface of the drum, this belt having a toothed run, which is held taut and parallel to the direction of movement of the trailing end of the flexible element during winding and unwinding. A rotatable toothed wheel supported by the trailing end of the flexible element engages the toothed run of said belt, and a mobile rack is disposed parallel to said run of the belt, this rack engaging said toothed wheel. The rack is movable parallel to the toothed run of the belt and is biased by elastic means to progressively oppose unwinding of the flexible element.

Yet another embodiment comprises at least one endless screw disposed generally parallel to a direction of movement of the trailing end of the flexible element. A nut non-rotatably engaged on the screw is fixed to the trailing end of the flexible support. The endless screw is kinematically coupled to said winding support by means which displace the nut and trailing end of the support faster than the tangential speed of unwinding of the flexible element from the winding support. In this embodiment, the kinematic coupling advantageously comprises a torque limiter.

BRIEF DESCRIPTION OF THE DRAWINGS

The accompanying schematic drawings show, by way of example, several embodiments of the invention. In the drawings:

FIG. 2A is a partial rear elevational view thereof;

DESCRIPTION OF THE PREFERRED EMBODIMENTS

Figure 1:
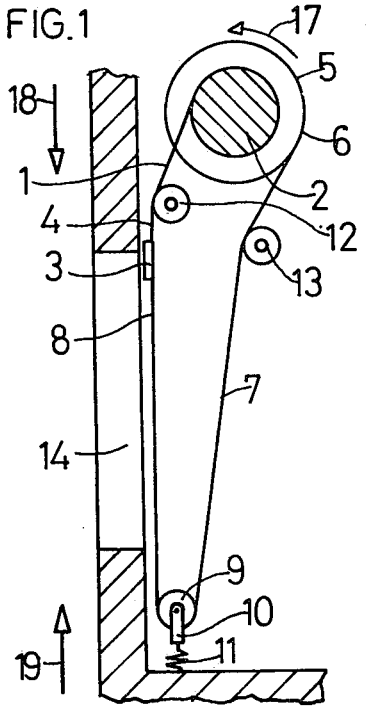
FIGS. 1 and 2 are side views of a first embodiment in two different positions.
Figure 2:
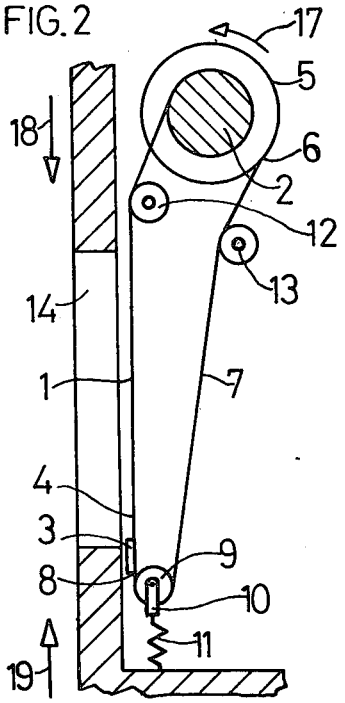

The arrangement shown in FIGS. 1 and 2 comprises a flexible sheet 1 wound on a cylindrical winding support or rod 2. A load bar 3 is fixed on the trailing end 4 of sheet 1. At each end of rod 2 is a drum 5, which, as already mentioned and as best shown in FIG. 2A, has a cylindrical surface, of greater diameter than the maximum diameter of the sheet 1 when it is fully wound on rod 2, the drums 5 being fixed for rotation with rod 2. On each drum 5 is wound, with an opposite direction of winding to that of the sheet 1 on rod 2, a first end 6 of a flexible cord 7 whose second end 8 is fixed to the bar 3. Each cord 7 passes about a pulley 9 rotatably mounted in a yoke 10 biased to tauten the cord 7 and sheet 1 by an extension spring 11. The sheet 1 and cords 7 are guided by respective guide pulleys 12 and 13, whereby the sheet 1 can be unwound to pass in front of an opening 14. This opening may, for example, by a window and the sheet 1 a blind or shade.

In the position of FIG. 1, the sheet 1 is completely wound on rod 2. The spring 11 exert a very slight tension on the cords 7 and sheet 1, just sufficient to prevent the cords 7 from flapping. When the rod 2 is turned in direction 17, the sheet 1 unwinds and bar 3 moves down as indicated by arrow 18. At the same time, each cord 7 winds on its drum 5. As the circumference of the drums 5 is greater than that of the sheet 1 wound on rod 2, it follows that for a given angular displacement of the rod 2 with drums 5, the length of each cord 7 wound on a drum 5 is greater than the length of sheet 1 unwound from rod 2. The intermediate part of cords 7 and sheet 1 is thus shortened. As a result, the pulleys 9 are displaced upwards, as indicated by arrow 19 and the springs 11 are extended and exert a greater tension on the cords 7 and sheet 1. Hence, as the sheet 1 unwinds from rod 2 its tension increases progressively, until the position of FIG. 2 is reached in which the sheet 1 is fully unwound and is subjected to a maximum tension. Conversely, when the sheet 1 is rewound, its tension decreases progressively.

Figure 3:
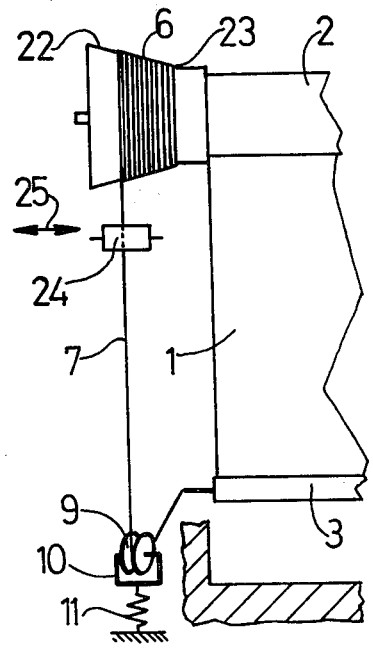
FIG. 3 is a rear elevational view of part of a second embodiment.

In the embodiment of FIG. 3, each of the previous cylindrical drums 5 is replaced by a drum 22 with a conical surface having a part 23 of smallest circumference which is for example equal to that of the outer turn of sheet 1 on rod 2. Each cord 7 is connected to its drum 22 at this part 23 of smallest circumference. The previous guide pulleys 13 are replaced by rollers 24 which allow lateral displacement of the cords 7, as indicated by arrow 25. The other elements are identical to those of the first embodiment, and are designated by the same references. During unwinding of sheet 1, the first end 6 of each cord is progressively wound on parts of the conical drum 22 of greater circumference and the tension of the cords 7 and sheet 1 thus increases more gradually than in the first embodiment.

Figure 4:
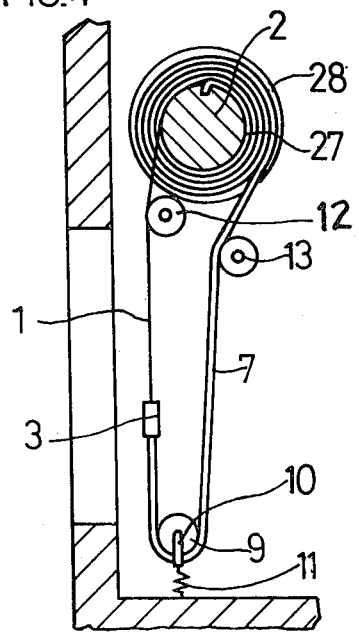
FIG. 4 is a side view of a third embodiment.

In the embodiment of FIG. 4 the drum 5 of FIG. 1 is replaced by a cylindrical drum 27 whose circumference is, for example, equal to that of rod 2, but could be greater, this drum 27 having a narrow width only approximately equal to that of the cord or cord-like unit, which in this case is advantageously formed by a flat belt 7. Each drum 27 has means, for example lateral guide flanges 28 fixed on either side to form a spool, for guiding its belt 7' to spirally wind it on the drum 27 in successive layers. All of the other elements are identical to those of the first embodiment and are designated by the same references. When the sheet 1 unwinds, the belts 7' wind spirally on themselves in successive layers whereby their winding "circumference" increases progressively for each rotation of the rod 2 and drums 27. The tensions of springs 11 and sheet 1 thus increase progressively during unwinding.

Figure 6:
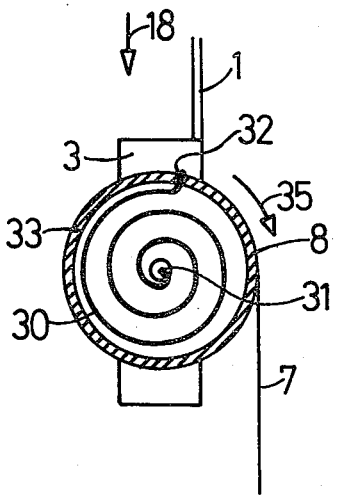
FIG. 6 shows a detail of FIG. 5 to an enlarged scale.
Figure 5:
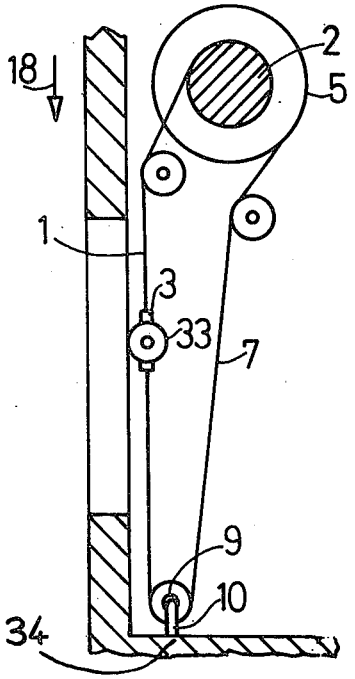
FIG. 5 is a side view of a variation of the first embodiment, which variation is also applicable to the second and third embodiments.

In the embodiment of FIGS. 5 and 6, the springs 11 of the first embodiment are replaced by spiral springs 30 supported by the bar 3. A first, inner end of each spring 30 is fixed at 31 to the bar 3 and its outer end is hooked in a slot 32 of a barrel 33 concentric with the spring on which barrel the second end 8 of a cord 7 is wound and suitably attached. Each barrel 33 is rotatably mounted on bar 3. In this embodiment, the yoke 10 of pulley 9 is secured to a fixed part 34; all of the other elements are identical to those of the first embodiment and are designated by the same references. During downward unwinding of the sheet 1, the cords 7 moving downwards at a faster rate, evidently unwind from barrels 33, as is clear from FIGS. 5 and 6. The cords, as a result, pull on the barrels 33 and cause them to rotate in direction 35, the springs 30 becoming progressively more stressed as the sheet 1 unwinds so that the tension of sheet 1 increases.

The spiral-spring device of FIGS. 5 and 6, or any equivalent extensible spring connecting the trailing end of sheet 1 to cords 7, could replace the spring 11 of the second and third embodiments (FIGS. 3 and 4).

Figure 7:
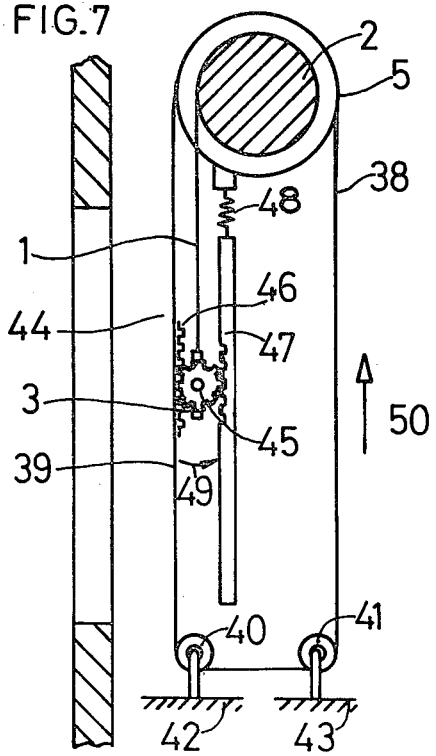
FIG. 7 is a side view of a fourth embodiment.

FIG. 7 shows an embodiment in which the rod 2 has cylindrical drums 5 whose circumference is greater than that of the winding of sheet 1. About each drum 5 passes an endless belt 38 having a run 39 which is constantly held taut and vertical (i.e. parallel to the direction of movement of the trailing end of sheet 1) by passing about pulleys 40 and 42 fixed at 42 and 43. Bearing surfaces may be provided at 44 along each vertical run 39 of the belts. At each end, the bar 3 carries a rotatable toothed wheel 45 one side of which constantly meshes with a toothing on a notched part 46 of the run 39 and its other side engages with the toothing of a mobile rack 47. The rack 47 is disposed vertically (i.e. parallel to run 39) and can move vertically in guide means, not shown. A compression spring 48 biases the rack 47 downwards.

When the sheet 1 unwinds, in view of the difference between the circumference of the winding of sheet 1 and that of the drum 5, the run 39 of each belt 38 moves linearly faster than the bar 3 and wheels 45. Consequently, each belt 38 drives the wheels 45 in direction 49 and the wheels 45, evidently acting in effect as levers bearing against racks 47, and thus against compression springs 48, move the racks 47 in direction 50 against the action of springs 48. As the pressure on springs 48 increases, the tension of sheet 1 increases progressively.

Figure 8:
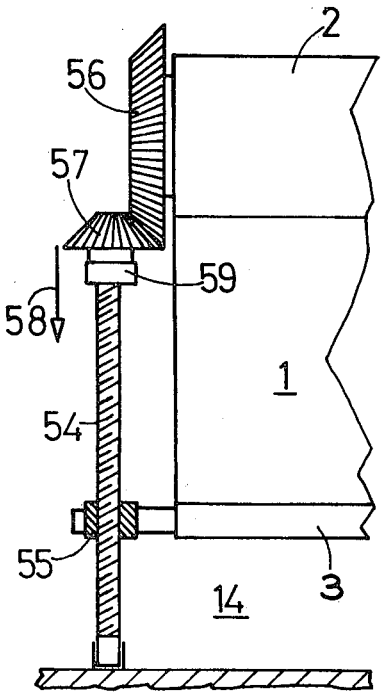
FIG. 8 is a rear elevational view of part of a fifth embodiment.

In the embodiment of FIG. 8, endless screws 54 are disposed vertically on either side of the opening 14, i.e. parallel to the direction of movement of the bar 3 and the trailing end of sheet 1. On each screw 54 is threadably engaged a nut 55 fixed to an end of the bar 3 and therefore held against rotation. Each screw 54 is kinematically connected to the rod 2 by means of a bevel gear 57 at its upper end meshing with a bevel gear 56 fixed on the end of rod 2. The kinematic ratio is such that as the sheet 1 unwinds, its trailing end, driven by the bar 3 and nuts 55, moves faster than its wound part unwinds tangentially from the rod 2. Consequently, a progressively increasing tension is exerted, in direction to 58, on the sheet 1.

A torque limiter 59 is advantageously arranged in the coupling, for example on screws 54, so that when the tension on the sheet 1 exerted by nuts 55 reaches a limiting value, a slipping is produced to limit the tension.

Tensioning devices according to the invention can be used in rolling screen arrangements in which the tension of the sheet or screen must be controlled with precision and where an increase in the tension as the screen unrolls may be desirable. Particularly interesting applications are blinds and shades of fabric, rolling blinds formed of articulated slats, rolling garage doors, and projection screens.

In all of the described embodiments, the sheet 1 unwinds behind an opening 14 which may be a door or window opening but, of course, in other arrangements the sheet or screen need not unwind behind an opening.

What is claimed is:

1. A rolling screen device comprising:

a frame having a rectangular opening therein, a roller extending along a first side of said opening and rotatably supported by said frame, a flexible screen having one end secured to said roller, said screen being windable as a roll on said roller by rotation of said roller in one direction and unwindable from said roller by rotation of said roller in the opposite direction, and a load bar secured to the opposite end of said screen, a drum fixed to said roller at each of opposite ends thereof to rotate with said roller whereby said drums rotate with said roller, a flexible cord wound on each of said drums in a direction opposite to that in which said screen is wound on said roller, said cord having one end secured to the respective drum and the other end connected with a respective end of said load bar, and guide pulleys over which said cords pass in going from said drum to said load bar, comprising movable tensioning pulleys and spring means acting on said tensioning pulleys to tension said cords and thereby tension said screen, the diameter of said drums being greater than the maximum diameter of the roll of said screen when fully wound on said roller so that when said roller and drums are rotated together in a direction to unwind said screen, said cords wind up on said drums at a faster rate than said screen unwinds from said roller, whereby the tension applied by said cords to said screen through said load bar is a minimum when said screen is fully wound on said roller and increases as said screen is unwound, and reaches a maximum when said screen is unwound sufficiently to position said load bar at the opposite side of said frame opening from said roller.

* * * * *